United States Patent [19]

Mestdagh

[11] Patent Number: 4,682,826

[45] Date of Patent: Jul. 28, 1987

[54] ANTI-THEFT SHOP DISPLAY CASE

[75] Inventor: Jacques Mestdagh, Loverval, Belgium

[73] Assignee: Figos, Societe Anonyme, Belgium

[21] Appl. No.: 746,024

[22] Filed: Jun. 18, 1985

[30] Foreign Application Priority Data

Dec. 6, 1984 [BE] Belgium ..... 2/60560

[51] Int. Cl.[4] ..... A47F 1/00

[52] U.S. Cl. ..... 312/42; 211/4; 312/60

[58] Field of Search ..... 312/42, 50, 60, 73, 312/211, 212, 312, 245; 292/344; 49/379; 70/158; 211/4; 221/154

[56] References Cited

U.S. PATENT DOCUMENTS

| | | | |
|---|---|---|---|
| 1,697,685 | 1/1929 | Grant | 49/379 |
| 2,295,313 | 9/1942 | Weir | 312/42 |
| 2,740,528 | 4/1956 | Kaiser | 211/4 |
| 3,717,258 | 2/1973 | McKinnon | 211/4 |
| 4,146,122 | 3/1979 | Harris | 221/154 |
| 4,387,810 | 6/1983 | Crosslen | 312/42 |

*Primary Examiner*—Joseph Falk

*Attorney, Agent, or Firm*—Bacon & Thomas

[57] ABSTRACT

An anti-theft shop display case, comprising a plurality of vertical magazines for containing a supply of vertically stacked articles, each magazine including a dispensing opening, a top opening for loading and a bottom opening for dispensing the articles, the case being provided with a lockable closure which, in its closed position, prevents access to the dispensing openings of the magazines.

3 Claims, 6 Drawing Figures

ANTI-THEFT SHOP DISPLAY CASE

This invention concerns an anti-theft shop display case. provided with an effective security device designed to avoid the theft of merchandise displayed for sale in such cases.

More specifically, the invention concerns an anti-theft shop display case for the classified storage of stackable articles.

In a preferred application, the invention concerns an anti-theft shop display case for the classified storage of cigarette packets, the anti-theft shop display case being capable of being closed in a simple manner. It is obvious that anti-theft shop display cases are particularly suitable for placing in supermarkets within proximity of the checkout tills. The effect of this is that before leaving her position, a till operator can first close this display case in a very simple manner. Closing the display case as foreseen by the invention may also be combined with the closing of the checkout till in such a way that closing the latter automatically causes the anti-theft shop display case to be closed.

In addition to security against theft, the shop display case as specified in the invention offers numerous other advantages. First of all, it is constructed in such a way as to make it easily and simply refillable. To this end, magazines are provided which may be filled from the top for inserting a stack of articles. The articles may be removed one by one from the bottom of the shop display case. This offers the advantage that the merchandise placed into the case first is served first, so that no old merchandise remains in the case.

The fact that the shop display case in accordance with the invention allows for the articles stacked inside it to be removable from the bottom makes it necessary to place these shop display cases at a certain height above floor level. The bottom edge of the case is preferably placed at a height of approximately 1.80 m from the floor. This offers a double advantage in that firstly, the panoramic view of the shop is not blocked by this display case and secondly, an electrical connection with the display case can be fitted into the ceiling, e.g. to illuminate an advertising panel fitted onto the display case.

A shop display case in accordance with the invention offers the further advantage that, in the majority of cases, especially if it is placed in the close proximity of a checkout till in a supermarket, it stimulates the customers to purchase packets of cigarettes or other articles displayed there.

In addition to the principal technical advantages set out above, the anti-theft shop display case offers a highly beneficial aspect on a financial and advertising level. Indeed, the considerable losses suffered each year through theft of such items as packets of cigarettes and other articles will be eliminated.

Moreover, the anti-theft shop display case offers the advantage, especially when installed in a supermarket, that up to four advertising panels can be fitted on the sidewalls of the display case.

It is obvious that these advertising panels exercise a significant psychological effect on customers. Indeed, during the time spent waiting in the checkout queue, the customer has time to be influenced by advertisements appearing on the panels.

The anti-theft shop display case in accordance with the invention consists of a number of vertical magazines, each capable of containing a supply of articles. These may be dispensed through a dispensing opening at the bottom of each magazine, while they may be refilled through a refilling opening at the top of the magazine, at a lockable closure unit being provided to lock the dispensing openings of the magazine.

In order to better demonstrate the characteristics of the invention, a preferred application is described hereunder and referred to in the attached sketches in which.

Figure 1:
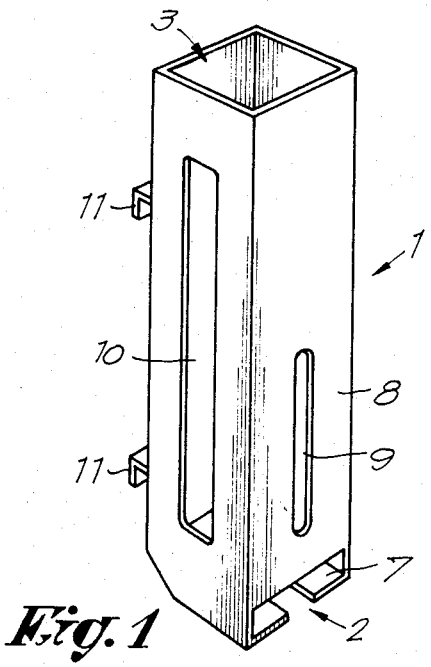
FIG. 1 is a frontal perspective view of a magazine in which the articles to be sold may be stacked.

As shown in FIGS. 1–4, in a preferred application, the anti-theft shop display case according to the invention consists essentially of a magazine provided with an opening 2 at the bottom for the dispensing of the articles and a refilling opening 3 at the top, mounted in a display case 4 in such a way as to be dismountable, and a vertically moveable closure 5 which, in the closed position of the anti-theft shop display case, closes the dispensing opening 2.

The vertical magazine 1 consists essentially of a holder in which the articles for sale may be stacked. To this end, magazine will preferably have an internal section of a shape corresponding to that of the articles to be stacked 6.

The refilling opening 3, of the magazine 1 is formed-therefor by an opening at the top while it is closed at the bottom by a bottom 7. The dispensing opening 2, adjacent to the bottom 7, is formed by a cutout in the front wall 8 of magazine 1.

Furthermore, magazine 1, preferably manufactured in plastic or aluminum, has a relatively narrow slot in its front wall 8 and a relatively wide slot 10 in each of its lateral walls. The rear side of magazine 1 has a number of hooks 11 which can fit onto a number of bars 12 fitted into the display case 4.

The closure 5 is composed of a horizontal bar which, in the closed position of the anti-theft shop display case, covers the dispensing opening 2 of magazine 1. The bar 5 can be slid upwards to give access to the dispensing opening. This maneuver may be facilitated by a countereight 13 to the bar in a suitable manner.

Figure 2:
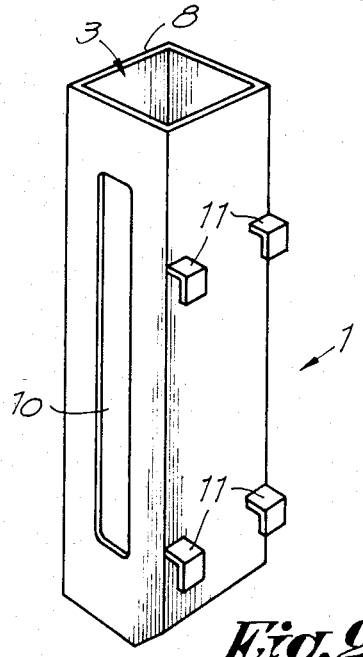
FIG. 2 is a rear view of the same magazine.
Figure 3:
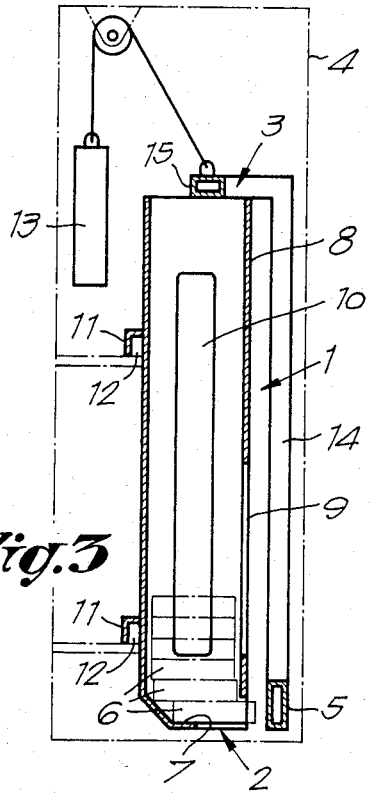
FIG. 3 is a schematic view of the closed anti-theft shop display case.
Figure 4:
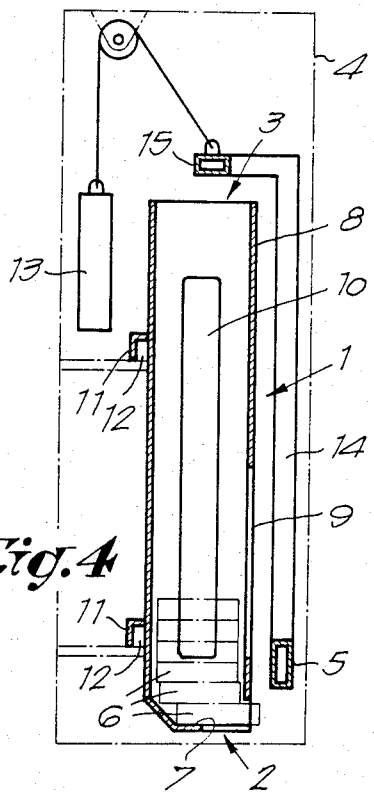
FIG. 4 is a similar view to FIG. 3 with the display case open.

In the embodiment shown in FIGS. 1–3, the closure 5 is part of a completely movable chassis, this latter being provided with a second bar 15. The whole unit is arranged in such a way that when chassis 14 is in its lowest position, i.e. with the closure 5 in the closed position, this bar 15 is just above the top of the magazine 1.

Figure 5:
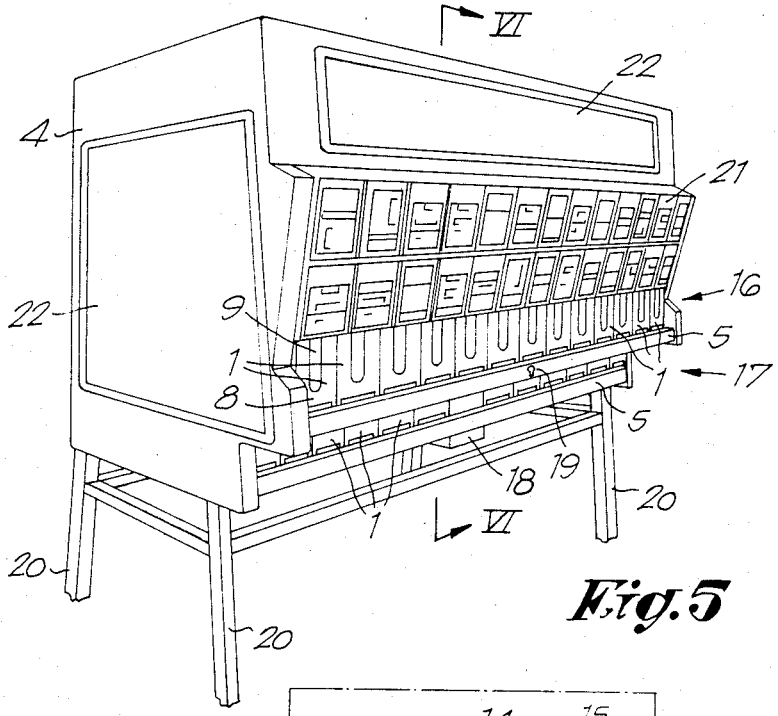
FIG. 5 shows a practical application of an anti-theft shop display case in accordance with the invention.

The chassis 14, in its lowest position, can be locked by means or a bolt of similar locking device 19 FIG. 5.

The operation of the described anti-theft shop display case may be clearly seen from the sketches. Referring FIG. 4, with chassis 14 in the raised position the articles 6 may easily be removed through the dispensing opening 2. To refill magazine 1, it should be unhooked from bars 12, after which it may be refilled through the refilling opening 3. The relatively wide slot 10 offers the advantage that articles 6 that fall awkwardly, may easily be reached in order to rearrange them into a suitable position. After being refilled, magazine 1 may be simply hung back onto the bars 12.

To close the shop display case, the closure 5 and thus also chassis 14 simply have to be lowered and locked using a locking device 19 referred to above.

Since in the closed and locked position of the shop display case, the bar 15 extends closely above the upper rim of the magazine 1, it is impossible to lift the magazine to unhook it from bars 12.

Figure 6:
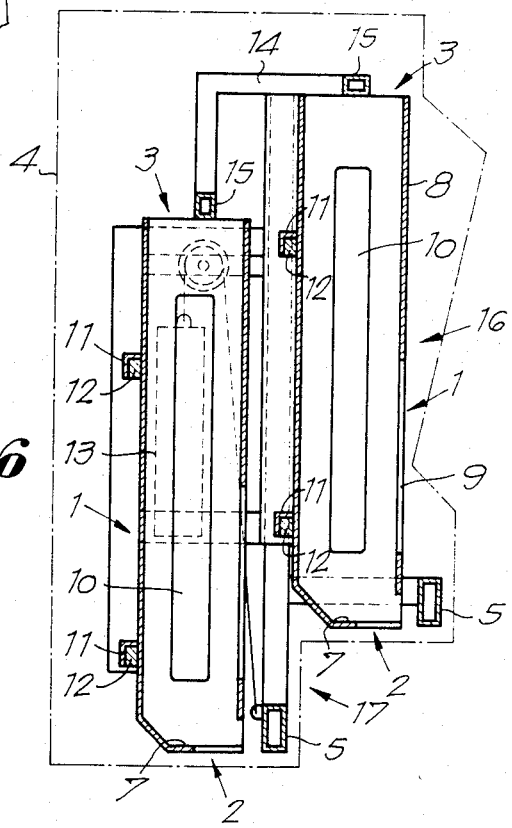
FIG. 6 is a cross section through line VI—VI in FIG. 5.

In the open position of the anti-theft shop display case, the counterweight 13 holds chassis 14 in the raised position. The slot 9 in the front wall of magazine of 1 enables the contents of column 1 to be assessed. This slot 9 does not under any circumstances give access to the stacked articles 6. The front wall 8 with the narrow slot 9 may be replaced by a transparent wall. FIGS. 5 and 6 show a practical application of the anti-theft shop display case in accordance with the invention. In the present case, 25 magazine 1 are provided into the display case. These magazines are arranged in two rows, 16 and 17. The rear row 17 is at a slightly lower level than the preceding row 16, such that it is possible to easily reach all the dispensing openings 2. In the application shown, row 16 is composed of 13 magazines, while the rear row is composed of 12 magazines. A space 18 is provided in the rear row 27 centrally of display case 4, to house the counterweight 13.

It is obvious that in the described example, the display case must be manufactured in such a way that it includes two closures 5 and two bars 15 to prevent magazines 1 from being unhooked.

The closure 5, and thus also the chassis 14', may be locked by a locking device 19 which causes the chassis 14 to be locked (not shown) in the display case 4.

The lower part of the display case 4 should preferably be at a height of 1.80 m from the floor. Strong supporting lets 20 are provided to support the shop display case. The upper part of the anti-theft shop display case as described hereinbefore is provided with a panel 21, on which may appear the brand names of the articles 6 stacked within the 25 different magazines.

Other advertising panels such as 22 may also be provided.

It is obvious that the anti-theft shop display case the locking of the closures 5 and the magazines 1 may be operated electrically. and connected to a checkout fill in the shop.

The shop display case as described hereinbefore is not limited to the sale of cigarettes, but given a suitable shape of magazines 1, all types of articles may be distributed in the display case, in particular prerecorded cassettes, video cassettes, films, matches, sweets, etc.

The invention is in no way limited to the attached sketches, but an anti-theft shop display case well as its component parts may be manufactured in other shapes and sizes without departing from the spirit of the present invention.

We claim:

1. An anti-theft shop display case assembly comprising:

(a) a display case;

(b) a plurality of horizontal supporting bars disposed within the display case;

(c) a plurality of rectangular-shaped magazines for containing supplies of vertically stacked articles, the magazines being displosable within and vertically removable from the display case;

(d) each magazine including a top opening for loading the articles therein, four vertical walls, a dispensing opening at the bottom of one vertical wall, and a plurality of hooks for engaging the supporting bars;

(e) the dispensing openings being positioned in a linear array when the magazines are disposed within the display case;

(f) a lockable closure including a vertically displaceable horizontal bar for preventing access to the dispensing openings;

(g) a locking means including a vertically displaceable locking bar for preventing vertical removal of the magazines, and a chassis carried by the display case coupling the horizontal and locking bars for joint vertical movement; and (h) means for vertically displacing the chassis between an open position wherein access to the dispensing openings is permitted, and a closed position wherein the horizontal bar is disposed across the linear array of dispensing openings for preventing access thereto and the locking bar is disposed across the top openings of the magazines for preventing their vertical removal.

2. The display case assembly of claim 1 wherein the means for vertically displacing the horizontal and locking bars includes a counterweight connected to the chassis for raising and lowering same.

3. An anti-theft shop display assembly comprising:

(a) a display case;

(b) a plurality of rectangular-shaped magazines for containing supplies of vertically stacked articles, the magazines being disposable within and vertically removable from the display case;

(c) each magazine including a top opening for loading the articles therein, four vertical walls, and a dispensing opening at the bottom of one vertical wall;

(d) means carried by the display case for supporting magazines in the first second rows, the first row being at a higher elevation than the second row and disposed forwardly thereof so as to define upper and lower rows of magazines, the lower row including a centrally-located space;

(e) the dispensing openings of the first row being positioned in a first linear array and the dispensing openings of the second row being positioned in a second linear array;

(f) a lockable closure; and (g) means for raising and lowering the closure between a closed position wherein the closure is disposed across the two linear arrays of dispensing openings for preventing access thereto and an open position for permitting access to the dispensing openings, which means includes a counterweight disposed within the centrally-located space, a pulley support by the case and disfused above the counterweight and the bottoms of the containers, and a cable encircling the pulley and connecting the counterweight to the lockable closure.

* * * * *